US008475118B2

(12) United States Patent
Mulcaire et al.

(10) Patent No.: US 8,475,118 B2
(45) Date of Patent: Jul. 2, 2013

(54) ROTOR PATH ARRANGEMENTS

(75) Inventors: Thomas Gerard Mulcaire, Derby (GB); Steven Aleksy Radomski, Nottingham (GB)

(73) Assignee: Rolls-Royce PLC, London (GB)

( * ) Notice: Subject to any disclaimer, the term of this patent is extended or adjusted under 35 U.S.C. 154(b) by 971 days.

(21) Appl. No.: 12/457,890

(22) Filed: Jun. 24, 2009

(65) Prior Publication Data

US 2010/0034645 A1 Feb. 11, 2010

(30) Foreign Application Priority Data

Jun. 25, 2008 (GB) ..... 0811577.6

(51) Int. Cl.
*F28F 7/00* (2006.01)

(52) U.S. Cl.
USPC ..... 415/134; 415/136; 415/173.2; 415/174.2

(58) Field of Classification Search
USPC ..... 415/134, 136, 137, 138, 173.1, 173.2, 415/174.1
See application file for complete search history.

(56) References Cited

U.S. PATENT DOCUMENTS

| | | | | |
|---|---|---|---|---|
| 2,638,743 A | | 5/1953 | Feilden et al. | |
| 2,826,261 A | | 3/1958 | Eckel | |
| 4,127,357 A | * | 11/1978 | Patterson | 415/116 |
| 4,332,523 A | | 6/1982 | Smith | |
| 4,787,817 A | | 11/1988 | LeGrange et al. | |
| 5,025,888 A | | 6/1991 | Arcas et al. | |
| 5,545,007 A | * | 8/1996 | Martin | 415/173.2 |
| 6,514,041 B1 | | 2/2003 | Matheny et al. | |
| 7,189,057 B2 | * | 3/2007 | Lee et al. | 415/136 |

FOREIGN PATENT DOCUMENTS

| | | |
|---|---|---|
| DE | 102 33 881 A1 | 2/2004 |
| GB | 2 024 336 A | 1/1980 |
| GB | 2 108 591 A | 5/1983 |
| JP | A-59-218307 | 12/1984 |

* cited by examiner

*Primary Examiner* — Dwayne J White
(74) *Attorney, Agent, or Firm* — Oliff & Berridge, PLC

(57) ABSTRACT

Within such machines as gas turbine engines it is desirable to provide close association between rotating assemblies and a rotor path arrangement to reduce leakage. However, such arrangements of rotor assemblies and rotor path arrangements are subject to thermal cycling and differentials between the respective parts can lead to rub associations. In order to allow closer thermal responses between the respective rotor path arrangement and rotor assembly, a flexible assembly is provided for a liner. A face surface is presented upon a backer plate or floating ring such that the thermal response can be tuned to the reciprocal similar effects under the same conditions of the rotor assembly. In such circumstances, closer gap control can be achieved. Furthermore, rather than requiring an entire integral casing to be overhauled, generally only the face surfaces and/or the flexible assembly will require remedial action.

20 Claims, 3 Drawing Sheets

ROTOR PATH ARRANGEMENTS

The present invention relates to a rotor path arrangement, and more particularly to a rotor path arrangement utilised with respect to a gas turbine engine.

In a number of machines and devices it is desirable to provide a casing which is in close association with a rotating or rotary member. The casing provides a rotor path arrangement minimising the gap between tips of the rotor blades and the casing to limit leakage.

An example of a rotor path arrangement is provided by a high pressure compressor (HPC) casing which lies in a gas turbine engine. These HPC casings are usually manufactured and built as a series of rings and bolted together to form an engine assembly. Normally the casing contains rotor path liners which present as a face surface an abradable material. As indicated, an objective of compressor design is to run with as little clearance as possible at the compressor blade tips, thereby minimising leakage and maximising efficiency. Unfortunately the thermal dynamic characteristics of the blade tips and casings differ throughout the operational cycle for an engine such that rubs can occur. In such circumstances, as indicated, casing faces incorporate an abradable material to prevent damage to the blades in contact with the casing.

The thermal response of the casing is generally much quicker than that of the rotor. Such differences can lead to a pinch point when the engine is throttled back to idle, the casings cool down whilst the rotors cool at a lower rate and therefore remain relatively hot. In such circumstances the rotors will be at a larger radius than when the engine is initially started up and run up to idle. In such circumstances if the engine is again run up to speed, then the rotors quickly grow radially outward due to centrifugal force whilst the casings are subjected to thermal and pressure effects only and respond more slowly. The rotors will rub on the casings in such circumstances to provide what is known as a full hot re-slam (FHR) event. Normally the permissible depth of such a full hot re-slam (FHR) event determines acceptable running clearances for a rotor path arrangement in association with a rotor during normal operation. In such circumstances there is an effect with regard to overall efficiency with respect to the rotor path arrangement.

Previous approaches to reduce problems with hot re-slam events whilst minimising running clearances during other operational stages, with regard to rotor path arrangements, generally tend towards slowing the response of the casing to thermal effects. If the rate of casing cooling can be lowered then effectively the clearance at the rotor tips will reduce more slowly so clashes between the rotor tips and the casing will be reduced. Through greater predictability and control with regard to clearances during potential rub events it may be understood that cold build clearances and hence hot running clearances between the rotor paths and the tips of blades can be reduced, improving overall operational efficiency with regard to the arrangement. One approach to reducing the rate of cooling of the casing is by addition of mass to the casing, such as through thicker flanges and T sections added to top flanges of the casing. Such an approach is termed slugging. It will also be understood that heat shields can be employed to the outer side of the casing to reduce bleed/leakage air heating the casings and insulation applied between the elements extending between the rotor path and the casing such as inlet guide vanes (IGV) in order to limit heat flow through those connecting elements to the casing.

A further alternative is to provide a more sophisticated control mechanism, either open or closed loop. Typically, such mechanisms require measuring clearances, directly or indirectly, and actuating rotor path displacements to achieve desired clearances through some or all operational stages, depending on the complexity of the system. However, it will be appreciated that such systems present higher reliability risks, add mass and increase part count associated with the arrangement.

In view of the above provision of additional mass such as through slugging is generally the preferred approach in order to improve performance. However, as each rotor path is influenced by the attached casing mass and other casing features it is generally difficult to effectively design the rotor path arrangement to provide a specific responsive. In such circumstances there is an empirical test process, which is generally iterative during an engine development programme, in order to establish the desired level of additional mass to achieve a desired response. Such an approach leads to uncertainty with respect to thermomechanical predictions of tip clearance. If significant architectural changes are required then the lead time to design and produce new casings can also be significant during development programmes for machinery such as gas turbine engines incorporating rotor path arrangements.

In accordance with the present invention there is provided a rotor path arrangement, and a gas turbine incorporating such an arrangement, as set out in the claims.

Embodiments of the present invention will now be described, by way of example, with reference to the accompanying drawings in which.

Figure 1:
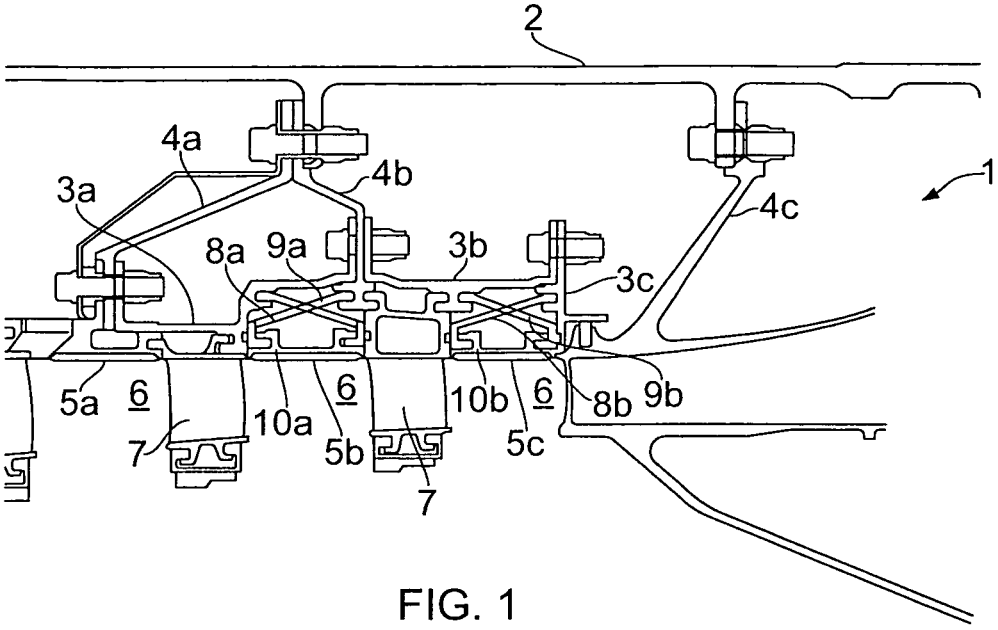
FIG. 1 is a cross-section of a rotor path arrangement in accordance with the present invention.
Figure 2:
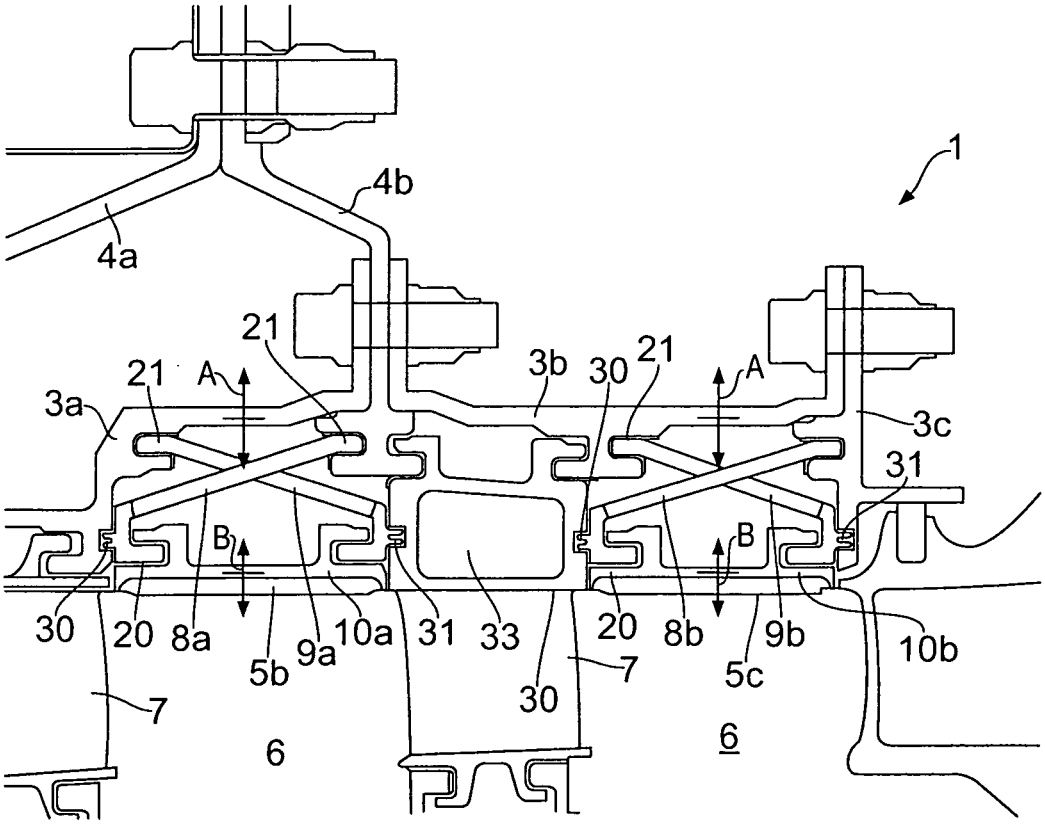
FIG. 2 is a more detailed illustration of the rotor path arrangement depicted in FIG. 1.
Figure 3:
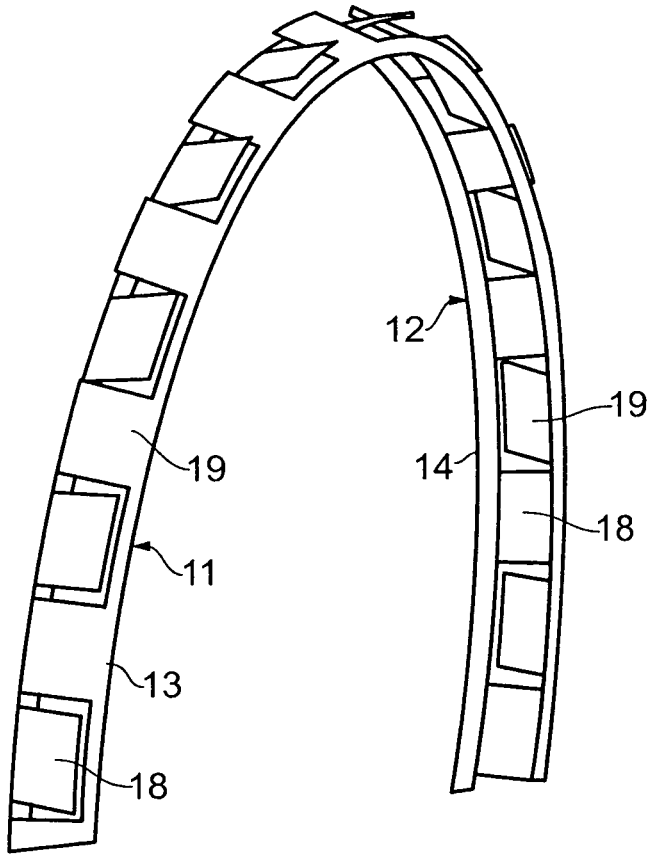
FIG. 3 is a pictorial perspective view of interleaved flexible assemblies in accordance with the present invention.
Figure 4:
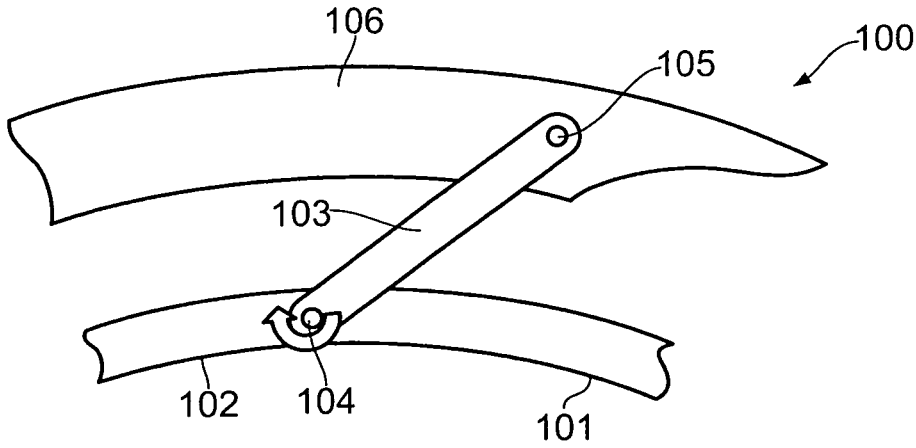
FIG. 4 is a schematic end view of an alternative flexible assembly in accordance with the present invention.
Figure 5:
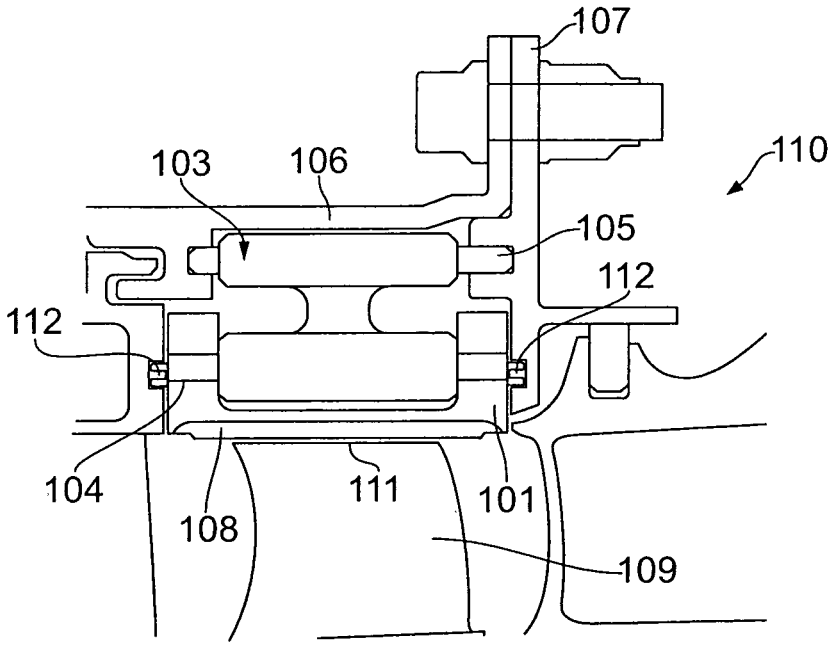
FIG. 5 is a side view of the assembly depicted in FIG. 4.

As indicated above, accurate control and limitation of the gap between a rotor assembly and a rotor path will improve efficiency in machines such as gas turbine engines. Nevertheless, there will inherently be some rub between the rotors and the rotor path such that the rotor path in particular will need periodic replacement or refurbishment. The present invention separates the rotor path and lining from the casing to form separate and independent components. The rotor path lining is mounted upon the casing through a flexible mounting. The flexible mounting can be in a number of forms. FIGS. 1 to 3 show one flexible mounting form, and FIGS. 4 and 5 show an alternative form.

FIG. 1 shows a rotor path arrangement 1, comprising a structural outer casing 2 to which an inner casing 3 is secured through plates 4. The inner casing 3 comprises a number of rings 3*a*, 3*b*, 3*c* which extend about the circumference of a common axis of rotation for blades (not shown) which will be closely associated with a rotor path 5, and in particular face surfaces of the rotor path 5, in an area 6 depicted in FIG. 1. It will be noted that structural elements, such as guide vanes 7, will typically be associated with the casing 3 to improve fluid flow for operational purposes within the arrangement 1.

In accordance with the present invention, a flexible assembly is provided to allow independent provision of a rotor path 5. In the embodiment depicted in FIGS. 1 to 3, the flexible assembly is provided by interleaving pivot elements 8, 9, which extend across a rear side of the face surface provided by the rotor path 5. As illustrated, typically the face surface 6 in the rotor path 5 is presented upon a rotor path ring 10. As indicated above, the face surface 6 of the rotor path 5 is generally abradable, so as to limit damage to the rotor assembly when blade tips contact the face surface 6.

As shown in FIG. 3, the interleaving elements 8, 9 are generally presented as fingers on a ring extending such that the elements 8, 9 are angularly presented across a rear side of the face surface provided by the rotor path 5. The arrangement of FIG. 3 will be described in more detail below. Provision of such a ring is advantageous in assembly, but it will be appreciated that, as an alternative, brackets could be associated with the inner casing to allow association of the rotor path 5 with the remainder of the arrangement.

Typically, the rotor path ring 10 and elements 8, 9 will be formed from a similar material to the casing 2; however, a different material may be utilised, depending upon thermal dynamic response to temperature changes or in accordance with operational requirements. The face surface 6 of the paths 5 will be presented with an abradable liner, which will be applied by a known technique to the inward facing surface 6 of the path 5.

With provision of flexible mountings in accordance with the present invention, the thermal dynamics of the rotor path can be specifically designed to match the thermal dynamics of the rotor blade assembly as closely as possible without influencing the surrounding casings. It will be appreciated that, with prior integral casings, consideration of the whole thermal mass is required, whereas by providing an assembly of independent components to provide the rotor path in accordance with the present invention more convenient thermal tuning can be achieved. Clearly, there will always still be thermal conduction and convection between the respective parts, but such heat transfer (and in particular cooling) can be controlled to achieve greater correspondence between the rotor assembly and thermal responses and changes in the rotor path. In particular, by judicious choice of the cross-sectional shape of the flexible assembly and rotor path ring, then the correct thermal inertia and (by choice of an appropriate material with a suitable coefficient of thermal expansion) greater cohesion in the thermal dynamics of the respective rotor path and the rotor assembly can be achieved. As indicated above the rotor path is formed from separate and independent components which can be made from different materials than the remainder of the casing and therefore a more suitable material chosen. In such circumstances the rotor path arrangement may be designed to have a suitable thermal time constant; that is to say, its thermal growth approximates to that of a free ring rather than to the whole casing.

Provision of a flexible mounting isolates the rotor path from the influence of thermodynamic changes upon the whole, particularly outer casing 2. The whole casing, as indicated, will have a different thermal mass and will be subject to heating and cooling. By isolating the particular components of the rotor path through the flexible mountings such changes in the overall casing dimensions can be completely or at least partially disconnected from the rotor path itself.

As described above, in a first embodiment flexible mounting rings, as shown in FIG. 3, are typically used. These mounting rings 11, 12 have respective elements 18, 19 which interleave with each other about the circumference of the rotor path. Typically the elements 18, 19 comprise flexible fingers which pivot along edges 13, 14 of the rings 11, 12. However, depending upon design requirements the actual cross-sectional area of the rings 11, 12 and in particular the elements 18, 19 will typically be chosen to maximise or tune flexibility to achieve the desired operational results.

The rings 11, 12 will generally be designed to extend to present the elements 18, 19 angularly across the rear of the facing surface. Typically, this angular presentation will be from about edge parts adjacent to and to the rear of the rotor path and in particular the face surface.

The rings 11, 12 may be provided with engagement features (not shown in FIG. 3) which in use will engage with corresponding features in the rear of the rotor path 5 and the inner casing 3 to prevent rotation of the rotor path 5 relative to the inner casing 3. Such rotation can be caused by vibration or by blade rub-induced torque. By preventing such rotation, these engagement features will facilitate timing of the rotor path relative to the structural casing, thus keeping locally rubbed areas of the abradable liner in the same circumferential location and thereby retaining local blade/liner clearances.

Referring to FIG. 2, it will be appreciated flexibility is important. In such circumstances generally, the elements 8, 9 will be arranged to engage the respective rotor path 5 and part of the casing 18 in grooves 20, 21. In such circumstances, essentially sliding joints are provided between the rings presenting the elements 8, 9 and the rotor path 5 and casing 3. It will be noted that these grooves 20, 21 may have lining elements which may facilitate such sliding, or wear resistance may be provided.

The provision of these grooves delivers an additional benefit, by reducing the radial height increase that would otherwise be required in the casing to accommodate the invention, and hence avoiding additional weight in the casings.

As an alternative to slide grooves, it will also be understood that the rings or other structures provided to present the elements 8, 9 in a flexible assembly could be secured through other means such as bolting.

Maintaining efficiency by avoiding flow losses is important in gas turbine engines. To help achieve this, seals 30, 31 may be provided fore and aft of the rotor path to prevent migration of gas flow radially outward of the compressor. As can be seen in FIG. 2, the seal is provided through parts of the rings defined in the elements 8, 9 in the flexible assembly engaging with a groove or recess in the casing 3.

As will be appreciated, expansion or contraction caused by heating or cooling will cause radial movements in the directions of arrows A, B in the respective rotor arrangement and rotor assembly shown in FIG. 2. By utilisation of a flexible assembly in accordance with the invention, the relatively larger radial movements indicated by arrow A, caused by the casing 2, will (to a certain extent) be isolated from the movements B as a result of the flexible assembly and rotor path ring 10. The invention allows these movements to be tuned to more closely replicate the movements of the rotor assembly to minimise gaps, thereby reducing leakage losses.

Typically, in a gas turbine engine, a number of parallel, concentric path arrangements will be provided. Between each pair of rings or stages of the engine, guide vanes 7 will typically be provided. These guide vanes 7 will be presented from mountings 33 which are secured to the casing 3.

The invention has particular advantages with regard to achieving an accurate blade tip to rotor path arrangement clearance. With less variation in the clearances in the rotor assembly, less wear should occur. It will also be understood that it is easier to adjust the rotor path 5 by changing elements of the rotor path ring 10 and flexible assembly as a result of practical prototype evaluation, compared with previous arrangements where the whole integrated casing must be redesigned. Furthermore, in service when renewal and replacement is required, rather than the whole casing requiring re-lining and renewal, only the abradable surface to provide the face surface 6 of the path 5 needs replacement. Thus, only the rotor path ring 10 with the flexible assembly will be removed and refurbished. In this way, servicing costs and maintenance may be reduced. Previous integral rotor path arrangements required the entire casing to be removed from an engine upon overhaul and the abradable lining material then be removed and a new liner re-applied. It will be appreciated that this is a complicated process and typically there is a finite number of times that the abradable liner can be applied before the whole casing must be discarded. Rotor paths in accordance with the invention can be quickly replaced during normal overhaul times and be separately re-worked or discarded, dependent on costs.

It is the provision of a flexible assembly which allows disconnection between the thermal expansion and contraction A of the casing 3 along with outer casing 2 which has particular advantages in accordance with the invention. An alternative form of flexible assembly is illustrated in FIG. 4 and FIG. 5. In the alternative arrangement 100, a floating ring 101 is used to define a rotor path with a surface 102 to oppose a rotor assembly. The ring 101 is presented upon a number of pivot links 103 (only one is shown) distributed about the perimeter of the ring 101. The links 103 are all of substantially the same length and evenly distributed about the ring 104. The links 103 are respectively secured at pivot points 104, 105 to the respective ring 101 and a support structure such as an outer casing 106. In such circumstances rotation about the pivots 104, 105 accommodates differential radial growth between the ring 101 and the casing 106.

FIG. 5 provides a side view of the arrangement depicted in FIG. 4. The same reference numbers have been used as in FIG. 4. Thus, a flexible arrangement of an alternative form is integrated within a casing arrangement 110 in which the casing 106 is secured by a plate 107, with the link 103 extending from that casing 106 to a floating ring 101. The link 103, as indicated previously, is associated with a floating ring 101 and the casing 106 through pivot points 104, 105. A surface 108 is presented towards a rotor blade 109 of a rotor assembly with a gap 111 controlled to minimise leakage and therefore improve efficiency. The floating ring 101 also incorporates seal elements 112 fore and aft in order to limit leakage. These sealing elements 112 are located within channels or grooves of the arrangement 110.

By using a number of evenly distributed links 103, as described above, the thermal dynamic movements of the casing 106 and other parts of the arrangement 110 are isolated from the floating ring 101 and the greater thermal dynamic movement of the ring 101 (and therefore the face surface 108) can be tuned to match the thermal dynamic movements of the rotor assembly.

It will be understood that the floating ring 101 may be formed of a material having a lower thermal expansion than the outer casing, to provide improved benefits with respect to full hot re-slam events. One material that may be utilised is tungsten, as this material has a low thermal expansion whilst having sufficient capacity to be operationally effectively at high pressure compressor stage temperatures in a gas turbine engine. However, other alloys and metals may also be suitable for other conditions and machines.

The invention provides an arrangement where it is easier to achieve matching between the rotor path arrangement and the outer blade assembly, in terms of thermal dynamics, to maintain a desired relative gap for reduction in leakage. By utilisation of flexible assemblies (particularly in the form of rings with pivoted fingers) during the design stages, with respect to a machine such as a gas turbine engine, it will be easy to adapt and adjust for particular prototype test results. Furthermore, instead of requiring the replacement of a whole integral casing, the present invention will allow replacement of only the flexible assembly as well as the backer plate and abradable lining material utilised in order to provide a face surface as the components during maintenance and overhaul.

The embodiments described relate to providing rotor path arrangements to confront rotor blades. The invention may also be utilised with regard to the notionally static seal portion of a rotary seal. It will be appreciated that such rotary seals may also be subjected to thermal cycling and therefore there will be displacement in the notionally static seal portion. By presenting the notional static seal portion as a face surface in accordance with the invention, opposing a rotating seal element, it will be possible to tune the arrangement to match the thermal dynamic movement of the rotor relative to the notionally static portion in order to reduce pinch point problems with respect to abrasion (and so wear) of the seal.

As indicated above, the invention relates particularly to gas turbine engines and other machines. Generally, as indicated above, in order to provide a rotor arrangement in accordance with the present invention an abradable lining will be provided. In such circumstances, generally the flexible assembly, in accordance with the present invention, will be presented in an enclosure formed by a casing and the backer plates presenting the face surface. Generally, the flexible assemblies define pivot elements which extend across this enclosure from respective edge portions of the face surface such that flexibility is achieved through a scissor like action. By the scissor like action there is distinct assembly that can be tuned and matched to the thermal actions of the opposing rotating components. It will also be appreciated that the scissor action can be adjusted as indicated above by changing the shape of the pivot elements, whether they be fingers as described with regard to FIGS. 1 to 3 or links as described with regard to FIGS. 4 and 5. Thus, the pivot elements may be curved or bowed or have sections removed or added to increase or decrease their flexibility as well as to reduce the level of thermal conductivity between the outer casing and the face surface to enable closer regulation and tuning of the thermal dynamic movement between the rotor path arrangement and the rotor assembly.

It is envisaged that the concept outlined in this patent can also be utilised for the turbine section of a gas turbine engine. The principle can be applied to both aerospace and ground-based gas turbine engines and indeed to any situation involving the necessity to maintain running clearance between a rotating member and a static member under a changing temperature and speed regime.

The invention claimed is:

1. A rotor path arrangement comprising a face surface for presentation towards a rotor in use, the face surface associated with a flexible assembly to present pivot elements angularly across a rear of the face surface, the flexible assembly comprising at least two rings, wherein the flexible assembly is presented within an enclosure to allow retention of the face surface relative to the rotor in use.

2. The arrangement of claim 1, wherein the pivot elements interleave with each other.

3. The arrangement of claim 1, wherein adjacent pivot elements are angularly presented in opposite directions.

4. The arrangement of claim 1, wherein the pivot elements substantially project from about a rear part of an edge of the face surface.

5. The arrangement of claim 1, wherein the face surface and the flexible assembly are separate components.

6. The arrangement of claim 5, wherein the face surface is located on a rotor path control ring that can be the same material or a different material than that of the flexible assembly.

7. The arrangement of claim 5, wherein the flexible assembly engages the face surface through a face groove in a back part of the face surface.

8. The arrangement of claim 1, wherein the flexible assembly engages a location groove in an enclosure.

9. The arrangement of claim 1, wherein the flexible assembly has a seal projection.

10. The arrangement of claim 9, wherein the seal projection is provided in a side of the flexible assembly.

11. The arrangement of claim 1, wherein the flexible assembly is secured by bolts.

12. The arrangement of claim 1, wherein the flexible assembly further comprises links extending between a pivot association with the face surface and a pivot association with an outer casing.

13. The arrangement of claim 1, wherein the face surface includes at least in part an abradable portion.

14. A gas turbine engine incorporating the arrangement of claim 1.

15. A rotor path arrangement comprising a face surface for presentation towards a rotor in use, the face surface associated with a flexible assembly to present pivot elements angularly across a rear of the face, the flexible assembly comprising at least two rings, wherein the flexible assembly has a seal projection.

16. The arrangement of claim 15, wherein the pivot elements interleave with each other.

17. The arrangement of claim 15, wherein adjacent pivot elements are angularly presented in opposite directions.

18. The arrangement of claim 15, wherein the flexible assembly engages a location groove in an enclosure.

19. The arrangement of claim 15, wherein the seal projection is provided in a side of the flexible assembly.

20. A rotor path liner arrangement for use with a rotor blade in a gas turbine engine, comprising: a liner having a face surface for presentation towards a rotor blade tip and a flexible assembly comprising a plurality of pivotable elements arranged at an angle with respect to and across the rear of the liner with respect to the face surface, the pivotable elements for engagement with an enclosure of the gas turbine engine, wherein the flexible assembly comprises two coaxial rings which extend circumferentially around the rotational axis of the rotor path, each ring including a plurality of the pivotable elements.

* * * * *